United States Patent [19]

Hirata et al.

[11] 4,423,826

[45] Jan. 3, 1984

[54] NOTE SUPPLY CONTAINER WITH REJECT RECEIVER FOR BANK NOTE DISPENSER

[75] Inventors: Akira Hirata; Takashi Shichinohe, both of Tokyo, Japan

[73] Assignee: Laurel Bank Machine Company, Tokyo, Japan

[21] Appl. No.: 343,593

[22] Filed: Jan. 28, 1982

[30] Foreign Application Priority Data

Feb. 2, 1981 [JP] Japan ..... 56-13947

[51] Int. Cl.[3] ..... B65H 7/00; G07G 5/00

[52] U.S. Cl. ..... 221/100; 109/24.1; 221/21; 221/198; 232/15; 271/9; 271/303

[58] Field of Search ..... 209/534; 271/9, 302, 271/303, 314, DIG. 9; 221/21, 97, 98, 99, 100, 101, 197, 198, 287; 109/23, 24, 24.1; 232/7, 15, 16, 43.1; 194/1 A, 1 B, 4 R, 4 B–4 G; 346/22; 235/379

[56] References Cited

U.S. PATENT DOCUMENTS

| | | | |
|---|---|---|---|
| 4,020,972 | 5/1977 | Lundblad | 194/DIG. 26 X |
| 4,106,667 | 8/1978 | Lynott | 221/97 X |
| 4,312,277 | 1/1982 | Graef et al. | 221/6 X |
| 4,319,132 | 3/1982 | Guibord et al. | 194/4 R X |
| 4,320,854 | 3/1982 | Hirose | 221/21 X |
| 4,363,584 | 12/1982 | Kokubo | 271/9 X |

FOREIGN PATENT DOCUMENTS

| | | | |
|---|---|---|---|
| 53-64097 | 6/1978 | Japan | 271/317 |
| 54-108698 | 8/1979 | Japan | 194/1 B |

*Primary Examiner*—Robert B. Reeves
*Assistant Examiner*—Edward M. Wacyra
*Attorney, Agent, or Firm*—Perman & Green

[57] ABSTRACT

A note disbursing machine is formed with a reject pool section instead of an independent reject box. An uppermost note receiving box is adapted to be accommodated in the note disbursing machine so as to face the reject pool section. The receiving box has an upper cover. A reject box for receiving rejected notes is rotatably mounted on the upper cover. A cover for covering the reject box and guiding the rejected notes is rotatably mounted on the reject box.

4 Claims, 6 Drawing Figures

FIG. 5
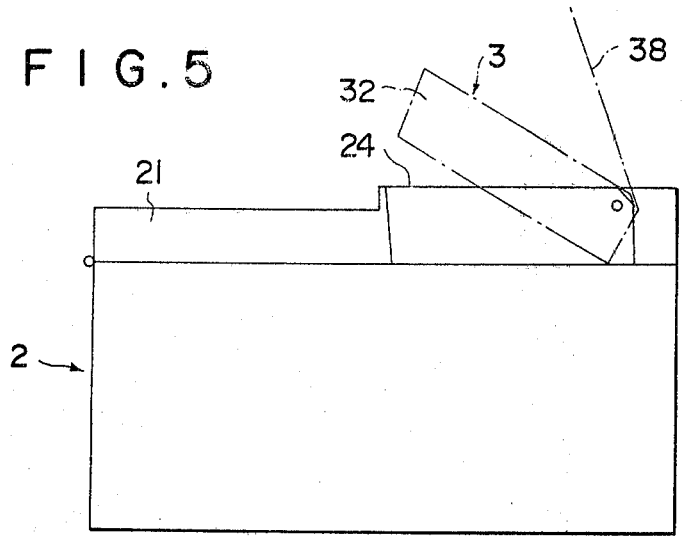
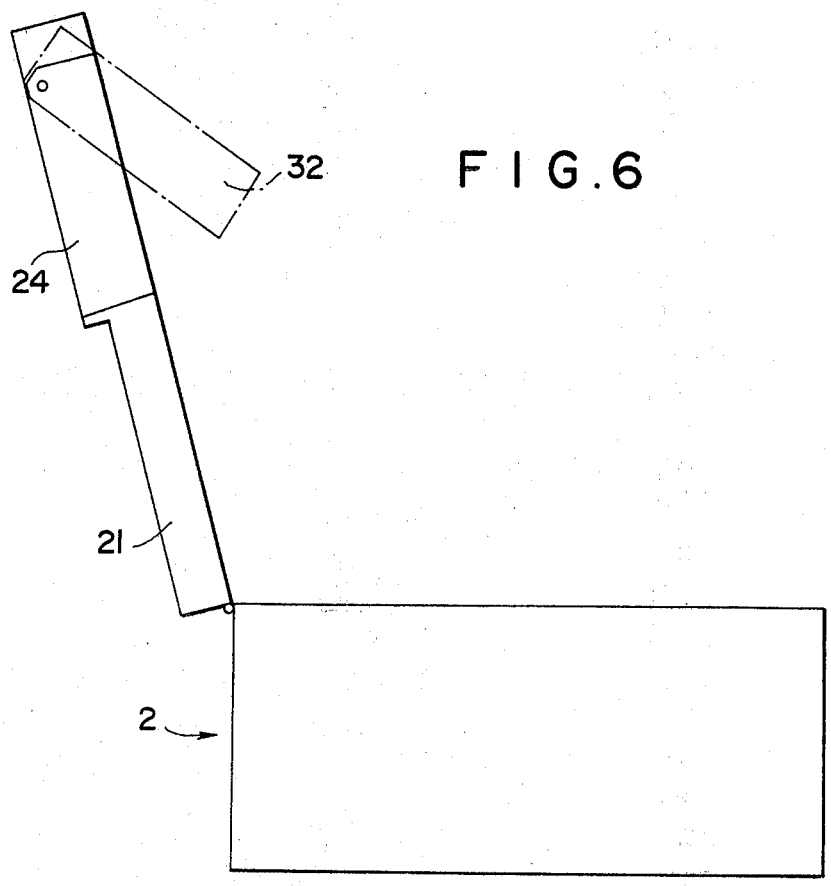
FIG. 6

NOTE SUPPLY CONTAINER WITH REJECT RECEIVER FOR BANK NOTE DISPENSER

BACKGROUND OF THE INVENTION

This invention relates to improvements in a bank note disbursing machine. More particularly, the invention relates to the construction of an uppermost note receiving box accommodated in a bank note disbursing machine.

Bank note disbursing machines function in such manner that the bank notes received in bank note receiving boxes are drawn, one at a time, out of the receiving boxes to be accumulated in an accumulating section and the accumulated bank notes are disbursed through a payment outlet or rejected into a reject pool section in accordance with the presence or absence of abnormality (for example, double delivery, delivery of different kinds of notes and the like). In most bank note disbursing machines, a reject box is provided separately of note receiving boxes. The reject box and each receiving box is provided with an opening and closing cover which is provided with a lock mechanism. Therefore, the reject box and each receiving box is made to serve as a safe. Consequently, such a construction has a disadvantage in that the bank note disbursing machine is make large and complicated.

SUMMARY OF THE INVENTION

It is, therefore, an object of the present invention to provide a bank note disbursing machine which can be made small and simple in construction.

In accordance with the invention, there is provided a bank note disbursing machine in which notes are drawn, one at a time, out of a note receiving box and transferred toward a payment opening when the notes are normal ones and accumulated into a reject box when the notes are not normal ones characterized in that the note disbursing machine is formed with a reject pool section above the uppermost note receiving box, the uppermost note receiving box comprises a receiving box body, an upper cover facing the reject pool section and rotatably mounted on the receiving box body, a reject box rotatably mounted on the upper cover, cover rotatably mounted on the reject box for covering the opening of the reject box, and a pull-up link connecting the reject box and the cover to be partially rotatable together.

DESCRIPTION OF THE DRAWINGS

Other objects and advantages of the present invention will become apparent from the following description made with reference to the accompanying drawings, in which:

FIG. 5 is a side view diagrammatically showing a reject box; and

FIG. 6 is a view similar to FIG. 5.

DESCRIPTION OF THE PREFERRED EMBODIMENT

One embodiment of the present invention will be now described in detail with reference to the accompanying drawings.

Figure 1:
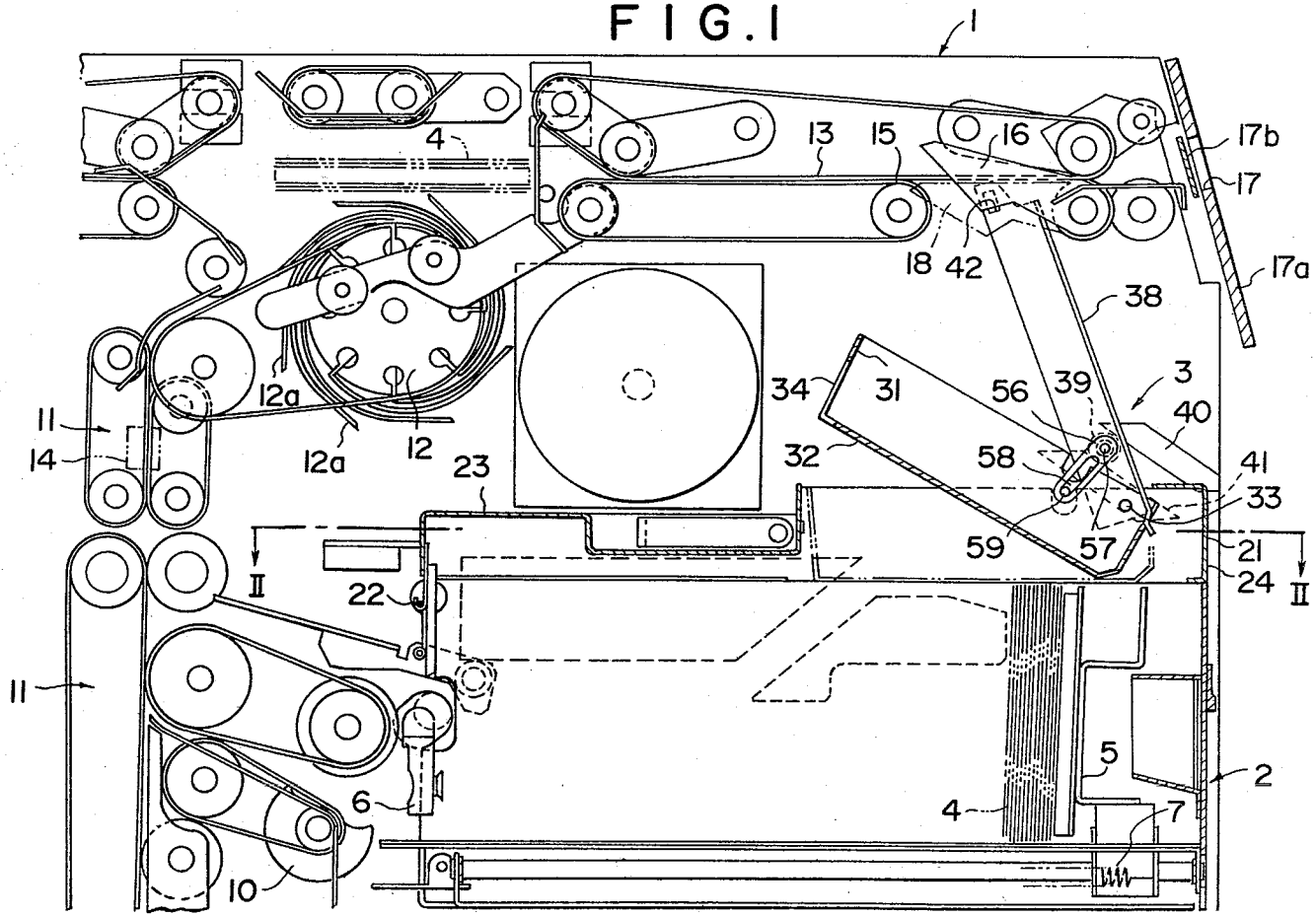
FIG. 1 is a side view partially in section, showing one embodiment according to the present invention.

In FIG. 1, there is shown an essential portion of a bank note disbursing machine 1 which is provided at its note receiving box 2 with a reject pool section 3. For better understanding, the construction of the note disbursing machine will be briefly explained first. The note disbursing machine 1 has a plurality of receiving boxes 2, in which bank notes 4 are accommodated in accordance with the kinds of the classified bank notes, and the notes 4 accommodated in each of the receiving boxes 2 are pushed by a movable holding plate 5 toward a suction head 6. The reference numeral 7 indicates a spring which serves to push the movable holding plate 5 toward the suction head.

The suction head 6 is swingably mounted to suck and take the bank notes, one at a time, out of the receiving box 2. The notes sucked by the suction head 6 are carried through rollers 10 and a conveyance system 11 between pawls 12*a* of an accumulating wheel 12 and accumulated on the upper portion of the accumulating wheel 12, as shown in broken lines in FIG. 1. Furthermore, the notes are checked as to double delivery of notes, etc. by a discriminating device 14 intermediate of the conveyance system 11.

The notes 4 accumulated on the upper portion of the accumulating wheel 12 are conveyed horizontally by a horizontal conveyance system 13. When the discriminating device 14 has judged that the passage of the notes is normal, the notes are delivered from a conveyance path 15 of the conveyance system 13 onto a gate plate 16 positioned as shown in broken lines in FIG. 1 and finally disbursed through a payment outlet 17. On the other hand, when the discriminating device 14 has judged that the passage of the notes is abnormal or the notes must be rejected, the notes are caused to drop into a reject pool section 3 from a dropping opening 18 by rotating the gate plate 16 to the position shown in solid lines in FIG. 1. The reference numeral 17*a* indicates a panel in which the payment outlet 17 is formed and the reference numeral 17*b* indicates a shutter for opening and closing the payment outlet 17.

Furthermore, an upper cover 21 is rotatably mounted on the upper portion of the note receiving box about a shaft 22 to cover the notes received in the note receiving box 2. Substantially half of the upper cover 21 on the left side thereof is formed by an upper plate 23. The upper cover 21 also has on the right side a frame 24 and a reject box 32, hereinafter described in more detail, which constitute a portion of the reject pool section 3.

Now, the construction of the reject pool section will be explained. At the reject pool section 3, the reject box 32 is rotatably mounted on the frame 24 of the upper cover 21 through a rotatable shaft 33 and has an opening 31 through which the notes to be rejected dropping from the dropping opening 18 are received into the reject box 32. The reject box 32 is formed at the front portion thereof (left side in FIGS. 1 and 2) with a downwardly opening notch 34. The notch 34 is engaged with a stopper 36 biased by a spring 35 and is thus supported so as not to enter the note receiving box 2. The reject box is formed at its bottom with a plurality of notched windows 37 through which the presence of rejected notes can be confirmed from the bottom side.

Furthermore, an opening and closing cover 38 for covering the opening 31 of the reject box 32 is rotatably connected to the rotatable shaft 33. The cover 38 has rollers 39 at its opposite sides. These rollers 39 are introduced between opening and closing cams 40 and 41 secured to the note disbursing machine 1, as shown in solid lines of FIG. 1, when the note receiving box 2 and, therefore the reject box 32 is charged into the note disbursing machine 1 so that the cover 38 is caused to open and consequently the inner surface of the end portion of the cover faces the conveyance path 15. The cover is formed at opposite sides with apertures 42. Lock pieces 43 are rotatably mounted on the upper plate 23 to lock and unlock the cover 38 by engaging their ends with the apertures 42 and disengaging their ends from the aperture 42.

Figure 2:
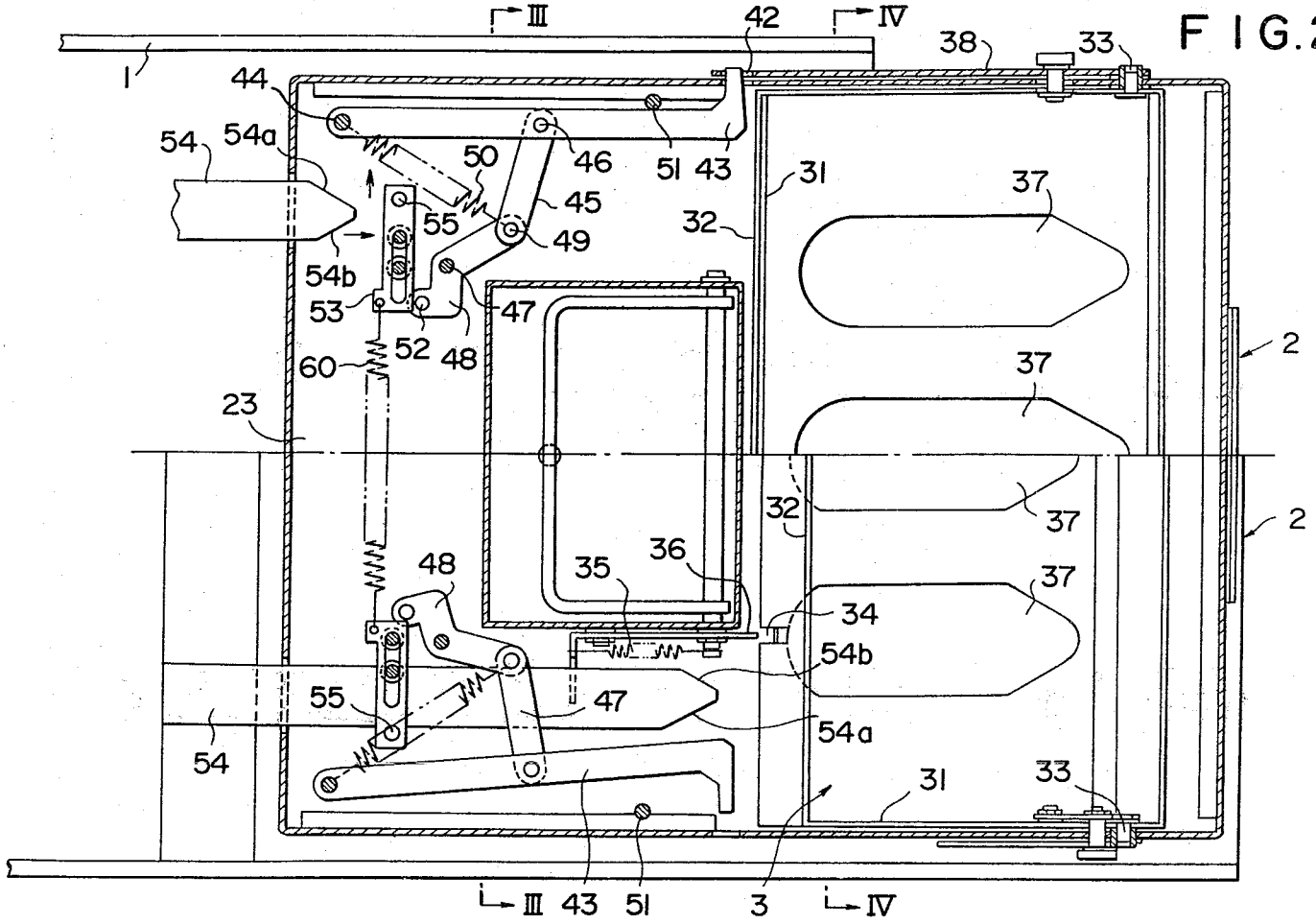
FIG. 2 is a cross-sectional view taken along lines II—II of FIG. 1, with the upper half section thereof showing a receiving box in the condition of being removed from the bank note disbursing machine and the lower half section thereof showing the receiving box in the condition of being accommodated in the bank note disbursing machine.
Figure 3:
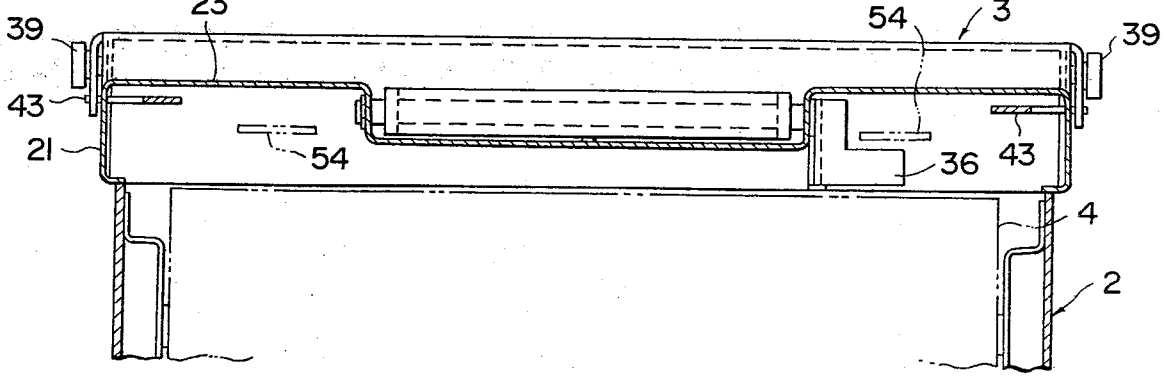
FIG. 3 is a cross-sectional view taken along lines III—III of FIG. 2.
Figure 4:
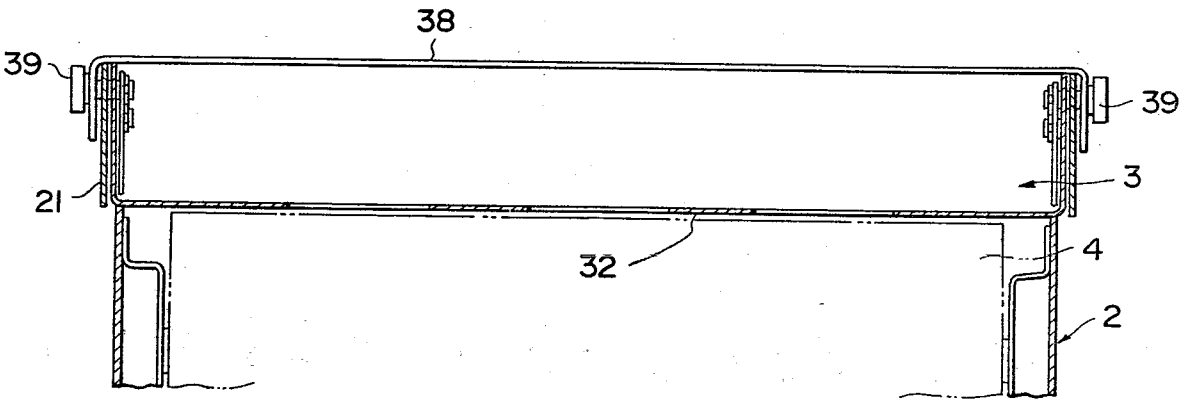
FIG. 4 is a cross-sectional view taken along lines IV—IV of FIG. 2.

That is, as shown in FIG. 2, each lock piece 43 is horizontally rotatably supported on a pin 44 and rotatably connected to a link piece 45 by a pin 46. The link piece 45 is connected through an actuating shaft 49 to an arm 48 which is rotatable about a pin 47. The actuating shaft 49 is biased toward the pin 44 by a spring 50. The position of the actuating shaft 49 is offset in the direction opposite to the pin 44 from a line connecting pins 46 and 47, as shown in the upper section of FIG. 2. Consequently, the lock piece 43 tends to be rotated in an anti-clockwise direction by the biasing force of the spring 50. The rotating operation of the lock piece 43 is limited by engagement of a limit pin 51 with the lock piece 43.

Furthermore, the arm 48 is provided at its end with a lock pin 52. The engagement of the lock pin 52 with a slide piece 53 slidably supported on the upper plate 23 maintains the engagement of the lock piece 43 with the aperture 42.

Furthermore, as the note receiving box 2 is charged within the note disbursing machine 1, lock disengaging pieces 54 integral with the note disbursing machine 1 enter the note receiving box 2, as shown in the lower section of FIG. 2. That is, firstly a projection 55 of the slide piece 53 is engaged and pushed by the lock disengaging piece 54 at one inclined surface 54i a thereof to put the lock piece 52 of the arm 48 in a free state. Then, the actuating shaft 49 is also engaged and pushed by the lock disengaging piece 54 at the other inclined surface **54*b* so that the lock piece 43 is caused to be rotated about the pin 44 and disengaged from the aperture 42. Consequently, the cover 38** is made openable.

A pull-up link 56 is provided so as to be associated with the reject box 32 and the cover 38. That is, the link 56 is rotatably connected to the cover 38 through a pin 57 and is formed with an elongated aperture 58 which supports a shaft 59 secured to the reject box 32 at its side. When the cover 38 is lifted up as shown in FIG. 1, the reject box 32 is also lifted up by the pull-up link 56 in a condition wherein the reject box 32 is maintained to be located in a relative angular position below the cover 38. On the other hand, when the cover 38 is brought down, both the cover 38 and the reject box 32 are brought down and accommodated into the upper cover 21 by the sliding movement of the shaft 59 in the elongated aperture 58 of the pull-up link 56.

An additional explanation about the reject pool section 3 will be made. In the case where the note receiving box 2 is removed from the note disbursing machine 1, the lock piece 43 is inserted into the aperture 42 of the cover 38 and, therefore, the cover 38 cannot be opened. This is because, even if an attempt is made push the lock piece 43 inwardly into the aperture 42, the rotation of the lock piece 43 is limited by the engagement of the lock pin 52 of the arm 48 with the slide piece 53 which is maintained in engagement with the lock pin 52 by a spring 60. For this, the upper cover 21 is lifted up as shown in FIG. 6 so that the bottom of the reject box 32 is visible and it is possible to confirm through the notched windows 37 whether any rejected notes are present in the reject box 32. In addition, the stopper 36 is disengaged from the notch 34 of the reject box 32 against the biasing force of the spring 35 and, then the reject box 32 is rotated in an anticlockwise direction. At the time, although the cover 38 of the reject box 32 is not rotated since it is supported by the upper cover 21, the reject box 32 can be rotated due to the elongated aperture 58 of the pull-up link 56 to provide access to the inside of the reject box 32.

After the rejected notes are removed from the reject box 32, the stopper is again caused to be engaged with the notch 34. Then, the upper cover 21 of the note receiving box 2 is closed and thereafter is charged into the note disbursing machine 1. The charging operation causes the cover 38 and the reject box 32 to be brought up to a position as shown in FIG. 1. That is, as the note receiving box 2 is forced into the note disbursing machine 1, the actuating shaft 49 is engaged with and pushed by the lock disengaging piece 54 to disengage the lock piece from the aperture 42. Then, the rollers 39 of the cover 38 are guided by the cams 40 and 41 to rotate the cover 38 upwardly and at the same time the reject box 32 is also rotated upwardly due to the pull-up link 56 and the shaft 59 as shown in FIG. 1.

In operation, in a case where a note 4 conveyed in the conveyance system 11 is judged to be not appropriate for payment by the discriminating device 14, the gate plate 16 is caused to be rotated from position shown in broken lines to position shown in solid lines of FIG. 1 to form the dropping opening 18 through which the note to be rejected is rejected. The note to be rejected is caused to strike against the gate plate 16 and then drop into the reject box 32. At the time, the cover 38 serves to prevent the dropping note from jumping out of the reject box 32 and to guide the dropping note into the reject box 32.

The reason why the reject box 32 and the cover 38 are inclined as shown in FIG. 1 when the note disbursing machine 1 is operated is as follows: If the rejected notes are much circulated ones, they may be folded. In such a case, after the rejected note drops from the dropping opening 18, it would tend to stand up on a horizontally positioned reject box, and this would reduce the number of rejected notes that could be accommodated. In order to prevent this, the reject box 32 is adapted to accumulate the rejected notes in inclined condition.

Furthermore, when the note receiving box 2 is removed out of the note disbursing machine 1, the cover 38 is caused to be rotated downwardly by sliding movement of the rollers 39 along the cams 40 and 41 to cover the opening 31 of the reject box 32 and to push the rejected notes downwardly. Therefore, even if the rejected notes include folded ones, all the rejected notes are compressed to be accommodated in the right box.

What is claimed is:

1. A bank note disbursing machine in which notes are drawn, one at a time, out of a note receiving box and transferred toward a payment opening when the notes are normal ones and accumulated into a reject box when the notes are not normal ones characterized in that the note disbursing machine is formed with a reject pool section (3) above an uppermost note receiving box (2), wherein the uppermost note receiving box (2) comprises a receiving box body, an upper cover (21) facing the reject pool section (3) rotatably mounted on the receiving box body, a reject box (32) rotatably mounted on the upper cover (21), a cover (38) rotatably mounted on the reject box (32) for covering an opening (31) of the reject box (32), and a pull-up link (56) connecting the reject box (32) and the cover (38) to be partially rotatable together.

2. A machine according to claim 1 wherein the machine is provided with cams means (40, 41) and the cover (38) is provided with rollers (39) for sliding along the cam means (40, 41) to cause the cover (38) to be rotated.

3. A machine according to claim 1 wherein the link is rotatably mounted on the cover (38) and has an elongated aperture (58) in which the mounting means (59) of the reject box (32) is slidably received, whereby the cover (38) and the reject box (32) are rotatable together when they are apart from each other by more than a predetermined angle.

4. A machine according to claim 1 wherein the machine is provided with a lock mechanism (43, 47, 48, 53, 54, 55) which serves to lock the cover (38) to the upper cover (21) when the note receiving box (2) is removed from the machine.

* * * * *